US006183571B1

(12) United States Patent
Inoue et al.

(10) Patent No.: US 6,183,571 B1
(45) Date of Patent: Feb. 6, 2001

(54) PERMANENT MAGNETIC MATERIAL AND PERMANENT MAGNET

(75) Inventors: Akihisa Inoue, 1-7 Yukigaya, Otsuka-Cho, Ota-ku, Tokyo; Akira Takeuchi, Sendai, both of (JP)

(73) Assignee: Akihisa Inoue, Sendai (JP)

( * ) Notice: Under 35 U.S.C. 154(b), the term of this patent shall be extended for 0 days.

(21) Appl. No.: 08/536,562

(22) Filed: Sep. 29, 1995

(30) Foreign Application Priority Data

Oct. 6, 1994 (JP) ..... 6-266090
Jun. 29, 1995 (JP) ..... 7-186316

(51) Int. Cl.[7] ..... H01F 1/053
(52) U.S. Cl. ..... 148/302; 420/83; 420/121
(58) Field of Search ..... 148/302; 420/83, 420/121

(56) References Cited

U.S. PATENT DOCUMENTS 5,022,939 * 6/1991 Yajima et al. ..... 420/83
5,049,208 * 9/1991 Yajima et al. ..... 148/302
5,089,065 2/1992 Hamano et al. ..... 148/302

FOREIGN PATENT DOCUMENTS

0306981 * 3/1989 (EP) ..... 148/302
1-228106 * 9/1989 (JP) ..... 148/302
1-253207 * 10/1989 (JP) ..... 148/302

* cited by examiner

*Primary Examiner*—John Sheehan
(74) *Attorney, Agent, or Firm*—Brinks Hofer Gilson & Lione

(57) ABSTRACT

With the object of improving magnetic properties by remaining amorphous phase of a quenched R—Fe—B permanent magnet, in a quenched permanent magnetic material comprising Fe as a major component, at least one lanthanoid element, R, and boron, the permanent magnetic material comprises 10 percent by area or less of a soft magnetic remaining amorphous phase, and the balance being a crystalline phase substantially formed by heat treatment and containing R—Fe—B hard magnetic compound. A bulk magnet is made of the permanent magnetic material by plastic forming.

6 Claims, 3 Drawing Sheets

PERMANENT MAGNETIC MATERIAL AND PERMANENT MAGNET

BACKGROUND OF THE INVENTION

1. Field of the Invention

The present invention relates to a permanent magnetic material, in particular to a Fe-lanthanoid-boron quenched permanent magnetic material and a permanent magnet made from the permanent magnet material.

2. Description of the Related Art

A Nd—Fe—B bonded magnet having excellent magnetic properties is commonly used in the field of compact and light weight magnets for use in electric products, cars and the like.

In U.S. Pat. No. 5,089,065, a permanent magnet is disclosed in which a ribbon-shaped thin film is formed by quenching a liquid mixture of five element components comprising Co and Y added Nd—Fe—B alloy, typically $Nd_{15}Fe_{88}B_7$, the ribbon film is powdered, then the obtained powder is formed into a block (bulk-type metal magnet) using a nylon resin. The patent states that the magnetic energy of the quenched ribbon is more than 17 MGOe or 135 kJ/m$^3$ in maximum energy product, $(BH)_{max}$. According to U.S. Pat. No. 5,089,065, the precipitation of the crystallite by the heat treatment of an amorphous alloy thin film is known, where $Nd_{11}Fe_{72}CO_8B_{7.5}V_{1.5}$ is heat-treated at 650° C. for 10 minutes and the maximum energy product (BH) max after heat treatment is 18 MGOe or 143 kJ/m$^3$.

Japanese Patent Publication No. 3-52528 discloses a melt-quenched magnetic alloy having the composition of $Nd_{0.1-0.5}$ $(TM_{0.9-0.995}B_{0.005-0.1})_{0.9-0.5}$, where TM represents a transition metal such as Fe, and an annealing method of the alloy after liquid-quenching in order to precipitate 20 to 400 nm of hard magnetic crystallite phases. The patent suggests that crystallite phase has a diameter less than the single magnetic domain, and $(BH)_{max}$ of $Nd_{0.15}(Fe_{0.95}B_{0.05})_{0.85}$ reaches about 14 MGOe or 111 kJ/m$^3$.

Permanent magnets have been investigated using Nd—Fe—B compositions having a lower Nd content than the above prior art references. For example, heat treatment of an amorphous ribbon having the composition of $Nd_4Fe_{77}B_{19}$ is proposed by R. Coehoorn et al. (J. de Phys., C8, 1988, pp 669–670). However, the compound does not exhibit an acceptable Curie-point.

Furthermore, the improvement in magnetic properties by remaining amorphous phases in the ribbon and by using the remaining amorphous phase is not disclosed in the above Japanese Patent Publication No. 3–52528 and U.S. Pat. No. 5,089,065.

Although conventional Nd—Fe—B liquid,quenched magnets have high performance characteristics, the magnets are not competitive against ferrite magnets on the basis of price because the most suitable Nd content is over 10 atomic percent causing a high price. Therefore, the ferrite magnets are still generally used for motors, actuators and the like for medium-sized or larger-sized industrial machines. By the way, the general properties of the ferrite magnets, which range from 0.2 to 0.4 T for Br, 0.13 to 0.26 MA/m for Hc, and 7 to 36 kJ/m$^3$ for $(BH)_{max}$, are significantly inferior to lanthanoid magnets. Under such circumstances, it is considered greatly significant to provide a magnet exhibiting the characteristics of Nd—Fe—B liquid-quenched magnet which are not as expensive as ferrite magnets, and which are acceptable for use in any common magnet applications.

Furthermore, the conventional Nd—Fe—B liquid-quenched magnets have been used as bonded magnets, and the powder cannot be directly bonded together without a resin binder due to poor formability. Thus, the conventional bonded magnets show poorer permanent magnetic characteristics due to the presence of the resin binder content.

SUMMARY OF THE INVENTION

It is an object of the present invention to provide a quenched permanent magnetic material comprising Fe as a major component, at least one lanthanoid element (abbreviated to R) and boron, wherein such material comprises 10 percent by area or less of a soft magnetic remaining amorphous phase, and the balance is a crystalline phase substantially formed by heat treatment and containing R—Fe—B hard magnetic compound.

It is another object of the present invention to provide a bonded magnet obtained by bonding the powdered permanent magnetic material with a resin or a bulk magnet obtained by compacting the magnetic material with plastic forming.

DESCRIPTION OF THE PREFERRED EMBODIMENTS

Figure 1:
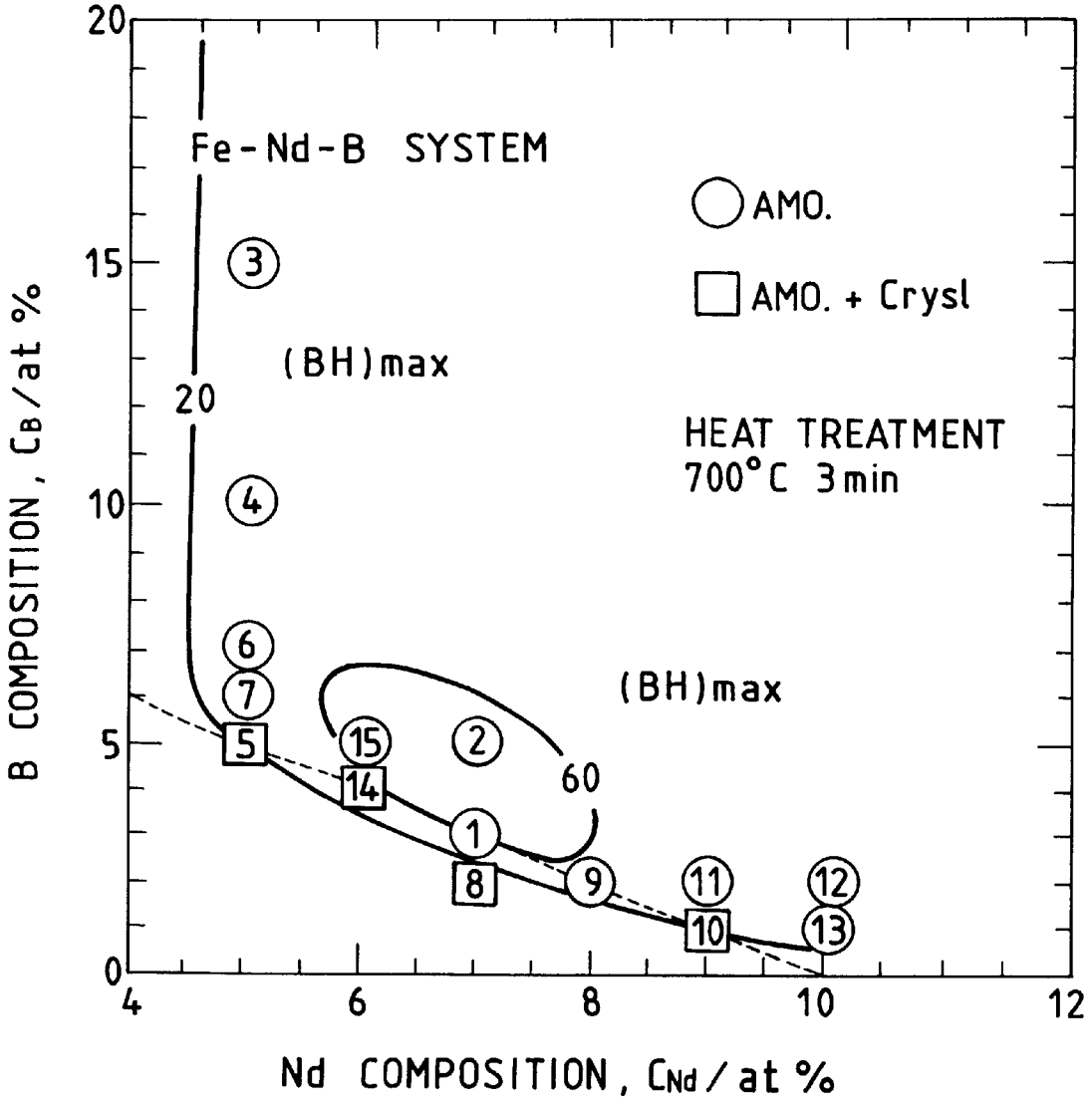
FIG. 1 is a graph showing the composition of Nd—Fe—B magnet concerning Nd and B contents, and $(BH_{max}$.

A permanent magnetic based on the present invention, mainly containing Fe, at least one lanthanoid element and B and showing hard magnetic characteristics, comprises a crystal phase formed by the crystallization of an amorphous alloy after heat treatment and a remaining amorphous phase without crystallization in a liquid-quenched material. The structure before heat treatment is preferably totally amorphous, but some crystalline phase may be included without affecting the magnetic properties.

The crystalline phase includes R—Fe—B compound having hard magnetic characteristics. On the other hand, the amorphous phase has soft magnetic characteristics and contributes less to the improvement in the magnetic properties than the crystalline phase. However, the amorphous phase improves the properties of the hard magnetic material and enhances the plastic formability of the magnetic material by reducing the crystal grain growth during heat treatment and promoting the formation of fine crystalline phase. The desirable grain size of the crystalline phase is from 5 to 100 nm. When the grain size is over 100 nm, a magnet field is formed in the soft magnetic phase causing decreased residual magnetic flux density. On the other hand, the grain size less than 5 nm is not suitable due to reduced magnetic properties of the crystalline phase. Preferable grain size ranges from 20 to 50 nm.

On the other hand, when the remaining amorphous phase is over 10 area percent (that is, 10 percent of the surface area of a sample section comprises the amorphous phase), the magnetic properties decrease due to released magnetic bonding among crystalline phases. The content of the remaining amorphous phase is suitably 2 to 10, and preferably 2 to 5 area percent. In order to reveal the effect of the above remaining amorphous phase, it is desirable to perform heat treatment at a temperature higher than the crystallization temperature for a short time, i.e. less than a few minutes.

Furthermore, when the crystalline phase contains a soft magnetic substance phase less than the width of the domain walls (also referred to as block walls), the decrease in the magnetic properties due to the soft magnetic phase can be reduced. In other words, when the soft magnetic phase is sufficiently smaller than the width of the domain walls, the magnetization of the soft magnetic phase is greatly restricted by binding with the magnetization of the surrounding hard magnetic phases and the whole system comprising the composite phase acts as a hard magnetic body resulting higher ratio of residual magnetic flux density (Br) to coercive force (iHc).

In the present invention, boron, the lanthanoid element, and oxygen (O) preferably exist in the amorphous phase at a higher concentration than in the crystalline phase. By optimizing the heat treatment condition on the partial crystallization of the amorphous phase, the compatibility of decreased B and Nd concentration in the crystal phase and relatively increased B and Nd concentration in the amorphous phase can be achieved. Such a concentration control causes a higher Curie-point, the improvement in magnetic properties, and the improvement in the temperature dependence of magnetic properties.

In the above system, it is suitable that the ratio of oxygen content ($O_c$:$O_a$) in the crystal phase ($O_c$) and the amorphous phase ($O_a$) is in the range of 1:1.5 to 1:7, the ratio of boron content ($B_c$:$B_a$) in the crystalline phase ($B_c$) and the amorphous phase ($B_a$) is in the range of 1:1.5 to 1:7, and an average grain size of the crystalline phase is in the range of 5 to 100 nm. In case of $O_a/O_c<1.5$, the Curie-point, Tc, of the amorphous phase decreases, and the magnetic properties at room temperature and the temperature dependence of the magnetic properties decrease, whereas in $O_a/O_c>7$, the amorphous phase is non-magnetized. Furthermore, in case of $B_a/B_c<1.5$, the Curie-point, Tc, of the amorphous phase decreases, whereas in $B_aB_c>7$, the amorphous phase is also non-magnetized.

In an embodiment of the present invention, the constituent in the crystalline phase of the permanent magnetic material comprises α-Fe, $Fe_3B$, and $Nd_2Fe_{14}B$ and these crystals form mixed crystals. Similarly, the amorphous phase comprises 70 to 90 atomic percent of Fe, 5 to 20 atomic percent of R, and 0 to 25 atomic percent of B.

The permanent magnetic material shows excellent magnetic properties and formability by satisfying the composition of $Fe_aR_bB_cX_d$, where R is at least one lanthanoid element, X is at least one selected from the group of Co, Si, Cu, Ti, Zr, Hf, V, Nb, Ta, Mo, W, Al, Cd, Au, In, Mg, Ni, Pd, Pt, Ru, Sn, and Zn, 40 atomic percent≦a<91 atomic percent, 4.5 atomic percent≦b≦35 atomic percent, 0.5 atomic percent≦c≦30 atomic percent, 0 atomic percent≦d≦5 atomic percent, and 9.5 atomic percent≦b≦+c. Among them, 0.5 atomic percent or more of B is required to form the amorphous phase. However, B over 30 atomic percent causes the decreased formability as well as the increased grain size over 100 nm. The total amount of R and B should be 9.5 atomic percent or more to form the amorphous phase.

The X element fills the role of refining the crystalline grain size and improving the heat resistance of the magnetic material, and this element exists in the state partially dissolved in the above α-Fe, $Fe_3B$, and $Nd_2Fe_{14}B$ or forms another phase.

On the magnetic properties, the preferable composition range is 65 atomic percent≦a<90 atomic percent, 4.5 atomic percent≦b≦7.9 atomic percent, 2 atomic percent≦c≦10 atomic percent, 0 atomic percent≦d≦5 atomic percent, and 10 atomic percent≦b+c. Furthermore, for plastic forming, the preferable composition range is 78 atomic percent≦a<91 atomic percent, 6 atomic percent≦b≦12 atomic percent, 3 atomic percent≦c≦10 atomic percent, and 0 atomic percent≦d≦5 atomic percent.

The permanent magnetic material in the present invention can be formed into a bonded magnet by binding in powdered state with a resin such as nylon. The permanent magnet powder content in the bonded magnet is generally 95 to 98 weight percent.

The bulk magnet is made of the liquid-quenched permanent magnetic powder by bonding deformation surfaces of the powdered particles by the plastic forming processes such as extruding, hot pressing and the like. The temperature of the plastic forming must be selected so as not to crystalize the magnetic material completely. The density of the bulk magnet obtained from the above process is generally 99.5 percent or less compared with the specific density.

On extruding bonding, the extruding temperature less than 350° C. does not cause successful extruding, and the temperature over 700° C. does not cause sufficient magnetic properties due to growing crystalline grain. A reduction of area less than 30 percent causes insufficient binding between powders, and it is difficult to extrude at a reduction of area over 80 percent in this alloy.

After extruding at a temperature ranging from 350 to 700° C. and a reduction of area ranging from 30 to 80 percent, the liquid-quenched amorphous phase can partially decompose into the crystal phase by the heat treatment if necessary. However, the heat treatment over 460° C. causes the decomposition of the liquid-quenched amorphous phase during plastic forming, so that heat treatment may be eliminated.

EXAMPLE 1

Four types of plastic Nd—Fe—B permanent magnets were extruded at various extruding temperatures and different reduction of areas, and formability and hardness of each sample were evaluated. The results are shown in Table 1. Where, the formability is evaluated the following four grades:

| | | |
|---|---|---|
| EX. | Excellent | Few gas cavity (Density over 99%) |
| G. | Good | Some gas cavities |
| N.G. | No good | many cavities |
| N.F. | No good | Not formable |

Among these four magnetic compositions, $Fe_{77}Nd_{4.5}B_{18.5}$ shows the poorest formability, and other three compositions exhibit satisfactory similar formabilities. A suitable processing temperature is ranges from 400 to 450° C. for excellent formability.

TABLE 1

| Composition | Extruding temp. | Reduction of area | Formability | Vickers hardness |
|---|---|---|---|---|
| $Fe_{90}Nd_7B_3$ | 300° C. | 30% | N.G. | — |
| | 350 | 30 | G. | — |
| | 380 | 50 | G. | 550 |
| | 380 | 90 | N.F. | — |
| | 400 | 20 | N.F. | — |
| | 400 | 25 | N.G. | — |
| | 400 | 50 | EX. | 560 |
| | 423 | 50 | EX. | 540 |

TABLE 1-continued

| Composition | Extruding temp. | Reduction of area | Formability | Vickers hardness |
|---|---|---|---|---|
| | 450 | 50 | EX. | 530 |
| $Fe_{89}Nd_7B_4$ | 400 | 50 | EX. | 560 |
| | 400 | 90 | N.F. | — |
| | 425 | 50 | EX. | 570 |
| | 430 | 50 | EX. | — |
| | 450 | 50 | EX. | — |
| $Fe_{89}Nd_8B_3$ | 400 | 50 | EX. | 550 |
| | 425 | 50 | EX. | — |
| | 450 | 50 | EX. | — |
| $Fe_{77}Nd_{4.5}B_{18.5}$ | 350 | 30 | N.F. | — |
| | 350 | 50 | N.F. | — |
| | 380 | 50 | N.F. | — |
| | 425 | 50 | N.G. | — |
| | 450 | 50 | N.G. | — |

A bulk-type magnet produced by bonding powdered magnetic material using a resin is generally isotropic. According to the present invention, an anisotropic bulk magnet having a high maximum energy product is obtained by solidifying only powdered permanent magnetic material by extrusion. In order to achieve a high anisotropy, significantly high reduction of area at extrusion, for example over 70 percent, causes the orientation to the extruding direction of the easy magnetizing direction of the crystalline phase. The anisotropy was confirmed by $E_A \neq 0$ at the measurement of anisotropic energy $E_A$.

EXAMPLE 2

Metal Fe, metal Nd and element B were weighed so as to be the composition of samples No. 1 to 15 in Table 2, and alloys were made by single roller liquid quenching; ribbons were made by jetting and quenching the melted metals having the above compositions on a rotating copper roller from the nozzle placed on the roller. The obtained ribbon is about 2 mm in width and about 30 $\mu$m in thickness.

The composition of the obtained ribbon after heat treatment at 700° C. for 3 minutes determined by X-ray diffractometry is shown in FIG. 1. At the boundary around 10 atomic percent of the sum of Nd and B contents, the higher atomic percent region is amorphous, and the lower region is a mixed phase of amorphous phase and fine crystalline phase. Thus, the range forming amorphous phase in Fe—Nd—B ternary system should be at least 9.5 atomic percent in the sum of Nd and B contents.

TABLE 2

| | Fe | Nd | B |
|---|---|---|---|
| No. 1 | 90 | 7 | 3 |
| No. 2 | 88 | 7 | 5 |
| No. 3 | 80 | 5 | 15 |
| No. 4 | 85 | 5 | 10 |
| No. 5 | 90 | 5 | 5 |
| No. 6 | 88 | 5 | 7 |
| No. 7 | 89 | 5 | 6 |
| No. 8* | 91 | 7 | 2 |
| No. 9 | 90 | 8 | 2 |
| No. 10 | 90 | 9 | 1 |
| No. 11 | 89 | 9 | 2 |
| No. 12 | 88 | 10 | 2 |
| No. 13 | 89 | 10 | 1 |
| No. 14 | 90 | 6 | 4 |
| No. 15 | 89 | 6 | 5 |

Remarks: *means Comparative Example

Figure 2:
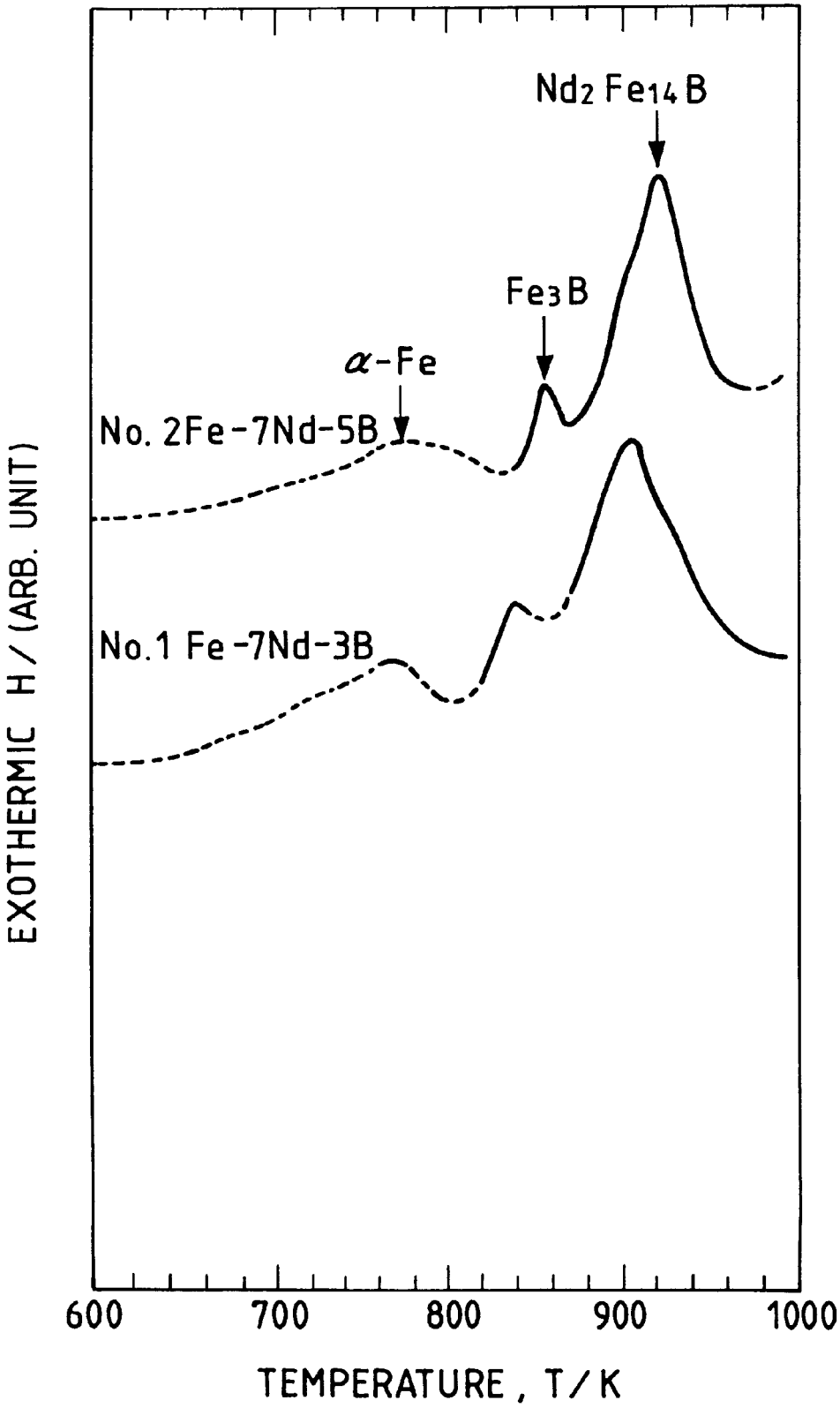
FIG. 2 is a graph showing the correlation between heat treatment temperature and formed crystalline phase.

FIG. 2 shows the results of the structure change during the heat treatment with DSC and X-ray diffractometry. In sample No. 1 and No. 2 clearly show three exothermic peaks corresponding to crystallization of α-Fe, $Fe_3B$ and $Nd_2Fe_{14}B$, respectively. FIG. 2 demonstrates that the samples No. 1 and No. 2 showing $FeB_3$ exothermic peak have excellent magnetic properties, as explained below.

Then, the ribbon of sample No. 1 was heat-treated at 700° C. for 3 minutes. The sample after the heat treatment included a mixed structure of fine crystalline phase comprising α-Fe, $Fe_3B$ and $Nd_2Fe_{14}B$ and amorphous phase.

Figure 3:
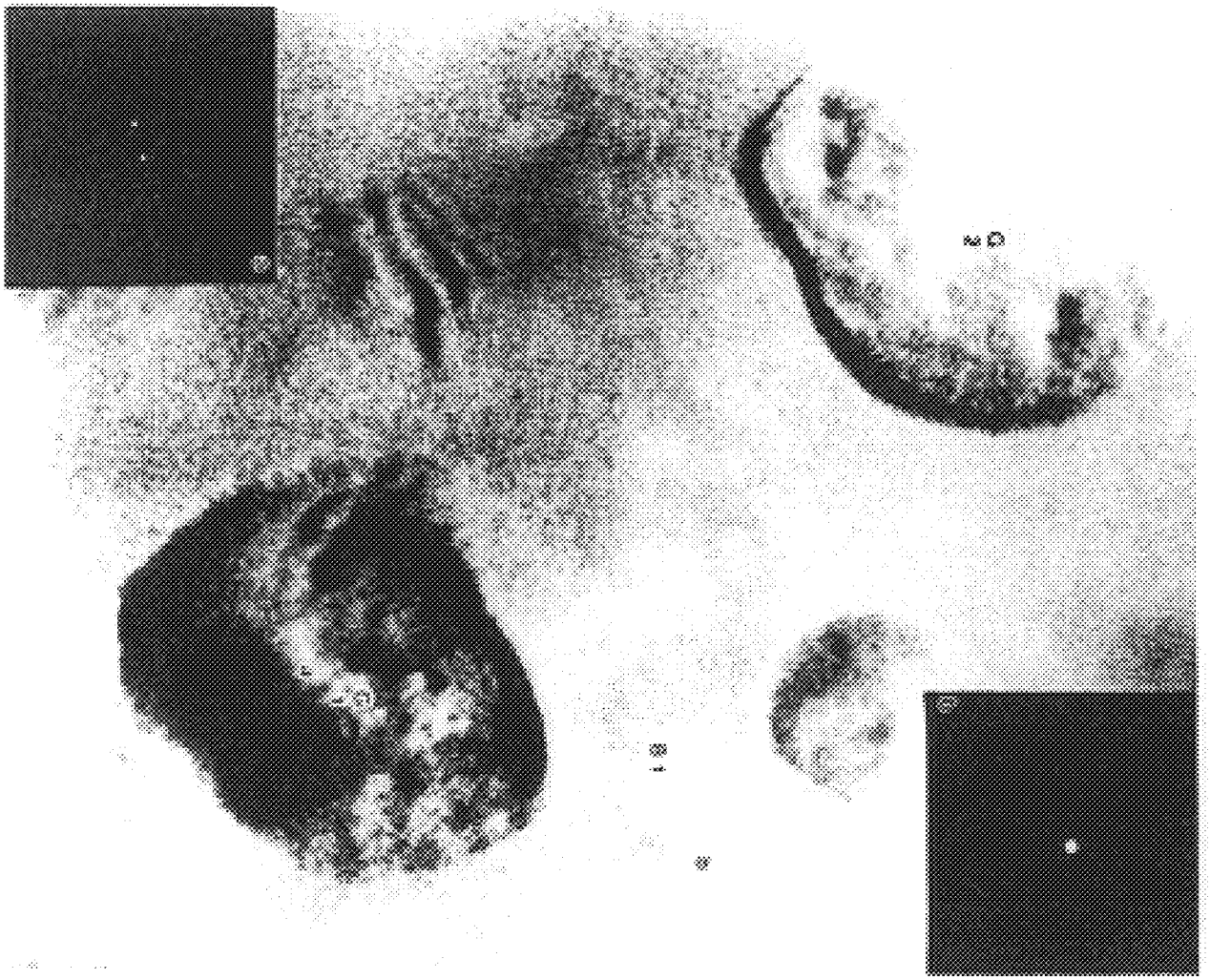
FIG. 3 is a transmission electron microscope photograph at 2,000,000 times as great as that of sample No. 1 after heat treatment at 700° C. for 3 minutes.

FIG. 3 is a transmission electron microscope photograph of the sample No. 1 after the heat treatment at 700° C. for 3 minutes. The photograph shows the coexistence of about 20 to 50 nm of fine crystalline phases and amorphous phases.

Similarly, the composition of the crystalline phase and amorphous phase of the sample No. 1 in the present invention after the heat treatment was determined at three locations of the sample using EDS. The results are shown in Table 3.

TABLE 3

Chemical composition of each phase in sample No. 1 (at %)

| | | Fe | Nd | B |
|---|---|---|---|---|
| Location 1 | Crystalline phase | 95.3 | 1.8 | 2.9 |
| | Amorphous phase | 83.6 | 11.2 | 5.2 |
| Location 2 | Crystalline phase | 95.7 | 1.5 | 2.8 |
| | Amorphous phase | 83.8 | 9.2 | 7.0 |
| Location 3 | Crystalline phase | 96.9 | 0.6 | 2.5 |
| | Amorphous phase | 73.7 | 13.2 | 13.1 |

Table 3 illustrates that Nd content in the amorphous phase at each location is higher than that in the crystalline phase. Here, the composition of B is calculated from the compounded B amount and the composition ratio of the crystalline phase to the amorphous phase shown in Table 4.

TABLE 4

The content ratio of B and O in Crystalline phase to amorphous phase

| | Sample No. 1 | | Sample No. 9 | |
|---|---|---|---|---|
| | B | O | B | O |
| (1) | 1:1.8 | 1:2.6 | 1:2.3 | 1:4.5 |
| (2) | 1:2.5 | 1:2.9 | 1:4.2 | 1:5.3 |
| (3) | 1:5.3 | 1:3.1 | 1:5.7 | 1:6.5 |

Table 4 shows the O and B contents contained in crystalline phase and amorphous phase of samples No. 1 and No. 9 in the present invention after the heat treatment by measuring three locations in each sample with EDS and PEELS. Table 4 shows that the O content in the amorphous phase is 2.6 to 6.5 times as much as that in the crystalline phase, and the B content in the amorphous phase is 1.8 to 5.7 times as much as that in the crystalline phase.

Table 5 shows results of the magnetic properties of the samples No. 1, 2, 8 and 9 after the heat treatment with VSM. Table 5 demonstrates that sample No. 1 and 2 based on the present invention have excellent $(BH)_{max}$ values, whereas sample No. 8 (out of the range of the invention) has inferior $(BH)_{max}$.

TABLE 5

| | Condition of heat treatment | Br (T) | Hc (MA/m) | $(BH)_{max}$ (kJ/m$^3$) |
|---|---|---|---|---|
| 1 | 700° C., 3 min. | 0.97 | 0.21 | 72.0 |
| 2 | 700° C., 3 min. | 0.96 | 0.19 | 61.4 |
| 8 | 700° C., 3 min. | 0.62 | 0.10 | 19.7 |
| 9 | 700° C., 3 min. | 0.86 | 0.16 | 35.7 |

In FIG. 1, the $(BH)_{max}$ after the heat treatment is plotted against the compositions of Nd and B. FIG. 1 demonstrates that the total amount of Nd as a lanthanoid and B is desirably 9.5 atomic percent or more in order to obtain the thin-film having $(BH)_{max}$ over 20 kJ/m$^3$, and preferably more than 10 atomic percent for $(BH)_{max}$ of 60 kJ/m$^3$.

Thus, when the structure after heat treatment comprises the fine crystalline phase and the amorphous phase, and Nd, O, and B are concentrated in the amorphous phase compared with the crystal phase, excellent magnetic properties can be achieved.

EXAMPLE 3

A liquid-quenched ribbon having the composition of $Fe_{89}Nd_7B_7$ (by atomic percent) was prepared by single roll method. The ribbon is amorphous single-phase according to X-ray diffractometry. Amorphous powder having grain size less than 150 $\mu$m was prepared by milling with a rotor speed mill. The obtained powder was filled into the container made of SS41 (Japan Industrial standard), degassed at 300° C. under vacuum, and extruded at 450° C. so as to become 50 percent of the reduction of area. A resulting bulk material had 99 percent of packing density. The structure of bulk material was amorphous single-phase. Then the bulk material is heat-treated at 750° C. for 5 minutes under a pressure less than $1\times10^{-4}$torr. The texture of the bulk material after heat treatment comprises amorphous phase, bcc-Fe and $Nd_2Fe_{14}B$. The magnetic properties of the bulk material are as follows: Br=13.0 kG (1.03 MA/m), iHc=3.2 kOe (0.25 MA/m), and $(BH)_{max}$=14.2 MG•Oe (113 kJ/m$^3$)

EXAMPLE 4

A liquid-quenched ribbon having the composition shown as sample No. 1 in Table 2, i.e. $Fe_{90}Nd_7B_3$ (by atomic percent), was prepared by single roller method. The ribbon is amorphous single-phase according to the X-ray diffractometry. Amorphous powder having grain size less than 150 $\mu$m was prepared by milling with a rotor speed mill. The obtained powder was filled into the container made of SS41, degassed at 300° C. under vacuum, and extruded at 490° C. so as to become 50 percent of the reduction of area. A resulting bulk material had 99 percent of packing density. The structure of bulk material was a mixed phase of amorphous phase and bcc-Fe. Then the bulk material was heat-treated at 750° C. for 3 minutes under a pressure less than $1\times10^{-4}$ torr. The structure of the bulk material after the heat treatment comprises amorphous phase, bcc-Fe and $Nd_2Fe_{14}B$. The magnetic properties of the bulk material are as follows: Br=10.8 kG (0.86 MA/m), iHc=2.3 kOe (0.18 MA/m), and $(BH)_{max}$=8.8 MG•Oe (70 kJ/m$^3$). These properties are somewhat lower than those of sample No. 1 in Table 5.

EXAMPLE 5

A liquid-quenched ribbon having the composition of $Fe_{89}Nd_7B_4$ (by atomic percent) was prepared by single roller method. Amorphous powder having grain size less than 150 $\mu$m was prepared by milling with a rotor speed mill. The obtained powder was filled into the steel container made of SS41, degassed at 300° C. under vacuum, and extruded at 680° C. so as to become 80 percent of the reduction of area while precipitating the crystal. A resulting bulk material had 99 percent of packing density. The structure of the bulk material after the extrusion comprises amorphous phase, bcc-Fe and $Nd_2Fe_{14}B$. The magnetic properties of the bulk material are as follows: Br=12.1 kG (0.96 MA/m), iHc=2.5 kOe (0.19 MA/m), and $(BH)_{max}$=13.0 MG•Oe (103 kJ/m$^3$). This sample shows the maximum energy product corresponding the Nd—Fe—B liquid-quenched ribbon of Nd=15 atomic percent.

Because the remaining amorphous phase enhances the energy at interface between the amorphous phase and the crystalline phase, the crystalline grain growth is depressed and the magnetic properties are improved. As the improving method for the magnetic properties using the remaining amorphous phase differs from the conventional method for the improvement in the properties of R—Fe—B compounds, the development of new materials can be expected based on the improvement of the amorphous phase.

Furthermore, besides the hard magnetic compound in the crystalline phase, $Nd_2Fe_{14}B$, the soft magnetic phases such as $\alpha$-Fe, $Fe_3B$ and the like also can act as hard magnetic phase by decreasing the crystalline grain size, so that the magnetic properties improve. In such a way, a permanent magnet composition having high Fe content, from which it is easy to form $\alpha$-Fe, can be made.

By increasing the Curie-point of the amorphous phase, the temperature dependence of the magnet will improve.

Reducing the lanthanoid element has a great advantage in lowering material cost. In addition, this magnetic material shows the same or higher level in $(BH)_{max}$, much higher level in Br, and excellent temperature dependence compared with ferrite. The practical application of the magnetic material is anticipated for industrial motors and actuators, particularly machines used at a high temperature due to these excellent properties.

Bonded magnets produced by binding the powder material of the present invention with a resin is ranked between conventional lanthanoid magnets and ferrite magnets on the performance and price, and is therefore competitive. In other words, the bond magnet of the present invention is suitable for uses not requiring high performance magnets, such as lanthanoid magnets, but being satisfied with the ferrite magnets.

On the other hand, the bulk magnet produced by directly binding the powder is more competitive because the magnet shows improved magnetic properties compared with the bonded magnet. According to the present invention, an anisotropic magnet, which is common in a sintered magnet, is obtainable without sintering. As a result, the bulk magnet has a similar characteristics to the conventional quenched ribbon magnet even at the almost 10% reduction of Nd content, so the bulk magnet has a significant cost reduction effect.

What is claimed is:

1. A permanent magnet obtained by binding with a resin a powder of quenched permanent magnetic material comprising Fe, at least one lanthanoid element R, and boron, the permanent magnetic material comprising about 2–10 percent of a soft magnetic amorphous phase and a balance being a crystalline phase containing an R—Fe—B hard magnetic compound;

wherein boron and a lanthanoid element exist in said amorphous phase at a concentration which is higher than a concentration in said crystalline phase;

wherein the composition of the permanent magnetic material expressed by atomic percent is $Fe_aR_bB_c$, $40 \leqq a < 91$, $4.5 \leqq b \leqq 35$, $0.5 \leqq c \leqq 30$, $9.5 \leqq b+c$; and wherein said quenched permanent magnetic material has a residual magnetic flux density Br of at least 0.96 T.

2. A quenched permanent magnetic material comprising Fe, at least one lanthanoid element R, boron and an element X, X being at least one element selected from the group of Cd, Au, In, Mg, Pd, Pt, Ru, Sn and Zn, wherein the permanent magnetic material comprises about 2–10 percent of a soft magnetic amorphous phase and a balance is a crystalline phase containing an R—Fe—B hard magnetic compound;

wherein said crystalline phase further includes a soft magnetic material phase smaller than the width of a domain wall of the permanent magnetic material; and wherein said boron and said lanthanoid element exist in said amorphous phase at a concentration which is higher than a concentration in said crystalline phase;

wherein the composition of the permanent magnetic material expressed by atomic percent is $Fe_aR_bB_cX_d$, $40 \leqq a < 91$, $4.5 \leqq b \leqq 35$, $0.5 \leqq c \leqq 30$, $0 \leqq d \leqq 5$, $9.5 \leqq b+c$; and wherein said quenched permanent magnetic material has a residual magnetic flux density Br of at least 0.96 T.

3. A permanent magnetic material according to claim 1, wherein $65 \leqq a < 90$, $4.5 \leqq b \leqq 7.9$, $2 \leqq c \leqq 10$, $10 \leqq b+c$.

4. A permanent magnetic material according to claim 2, wherein $65 \leqq a < 90$, $4.5 \leqq b \leqq 7.9$, $2 \leqq c \leqq 10$, $10 \leqq b+c$.

5. A permanent magnetic material according to claim 1 wherein said lanthanoid element is Nd.

6. A permanent magnetic material according to claim 2 wherein said lanthanoid element is Nd.

* * * * *